United States Patent [19]

Small

[11] 4,168,542

[45] Sep. 25, 1979

[54] HELMET FOR RACQUET BALL AND OTHER SPORTS

[76] Inventor: Irwin A. Small, 6861 Orinoco Cir., Birmingham, Mich. 48010

[21] Appl. No.: 922,568

[22] Filed: Jul. 7, 1978

[51] Int. Cl.[2] ..... A63B 71/10; A42B 3/00

[52] U.S. Cl. ..... 2/9; 2/424; 2/425

[58] Field of Search ..... D2/233; 2/6, 9, 10, 2/15, 410, 412, 421, 422, 424, 425, 431, 449, 450, 185 R, 195, 199

[56] References Cited

U.S. PATENT DOCUMENTS

| | | | |
|---|---|---|---|
| 2,715,222 | 8/1955 | Sowle | 2/9 |
| 2,889,555 | 6/1959 | Stuart et al. | 2/6 |
| 3,067,427 | 12/1962 | McClintock | D2/233 X |
| 3,751,728 | 8/1973 | Thompkins | 2/421 |

*Primary Examiner*—Louis Rimrodt

*Attorney, Agent, or Firm*—Cullen, Sloman, Cantor, Grauer, Scott & Rutherford

[57] ABSTRACT

A padded helmet for athletic events such as racquet ball, having a pair of metal wires extending between the bill of the helmet to the ear projections for protection of the eyes. The helmet is made of plastic and lined with a suitable plastic material. Cutout areas in the helmet are provided for venting. The helmet includes a dome-shaped head protective shell with a bill projecting forwardly from the end of the shell and a pair of earpieces depending from side portions of the shell. A taught wire is secured to each earpiece and extends to and is secured to a forward portion of the bill to protect the user's eyes against ball, racquet or wall impacts.

9 Claims, 5 Drawing Figures

FIG. 1
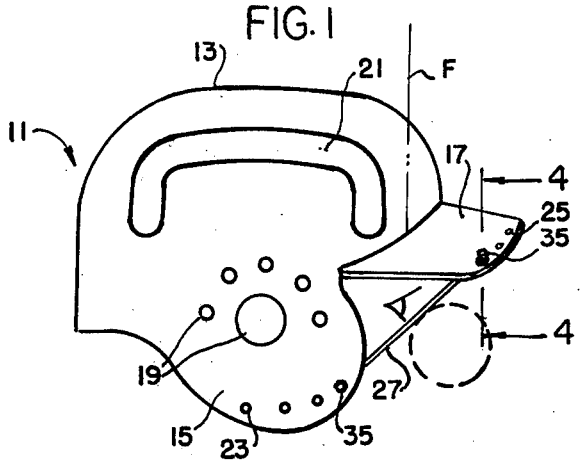
FIG. 4
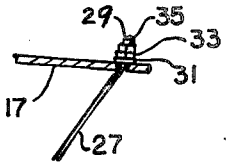
FIG. 2
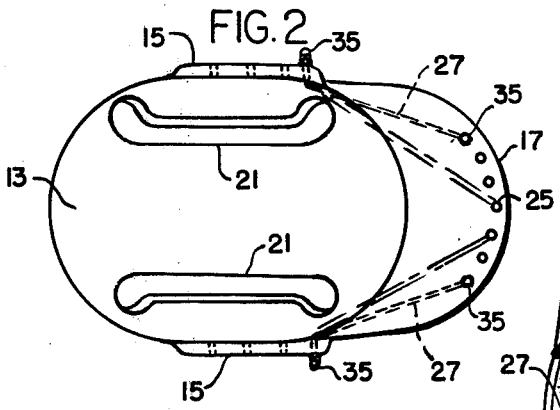
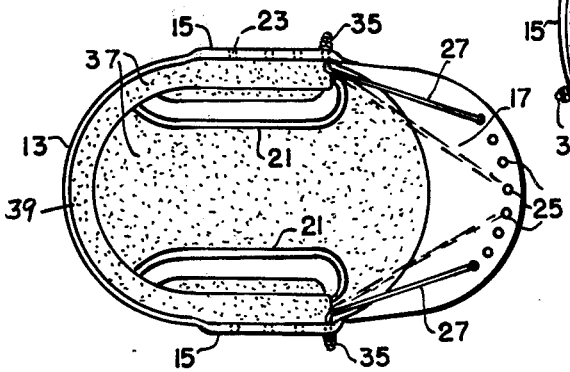
FIG. 3
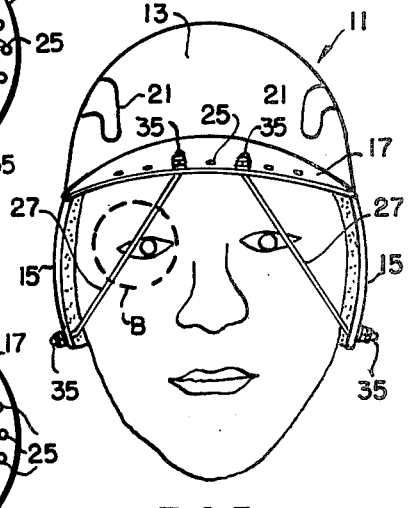
FIG. 5

HELMET FOR RACQUET BALL AND OTHER SPORTS

BACKGROUND OF THE DISCLOSURE

Examples of helmets with protective devices are shown in the following U.S. Pat. Nos. 3,658,054, 3,783,450, 4,051,555, and U.S. Pat. No. Des. 190,716.

Heretofore, in playing racquet ball and similar sports involving a ball and a racquet, the user's eyes have been injured, particularly by impact of the ball to the eye, or impacts from a racquet or from a wall.

Heretofore, a player is reluctant to look rearward, watching the other player in order to ascertain the other player's actions, for fear of a head or eye impact.

SUMMARY OF THE INVENTION

It is an object of the present invention to provide for a racquet ball helmet or the like an angle wire which extends between the bill of the helmet and each earpiece and wherein, the inclination of the wire is adjustable so that the wire lies just laterally outward of the pupil of each eye in a frontal projection.

It is an object to so place the wire so as not to obscure frontal vision.

It is a further object to provide wires upon the helmet so as to protect the eye from the racquet ball since the ball will strike only the bridge of the nose or wire if the helmet and wires are properly adjusted and fully protect the user's eyes against impact, particularly by the ball, or by a racquet or by the wall.

It is a further object to provide a helmet of this type and wherein, the bill thereof projects in a direction substantially at right angles to the vertical frontal plane of the helmet in order to protect the nose and upper face of the user against being hit by a racquet and at the same time, permit maximum frontal vision.

It is a further object to provide a helmet of this type which is vented to dissipate heat and perspiration and which is sufficiently padded with a resilient material to, otherwise, protect surface areas of the head and ears.

These and other objects will be seen from the following specification and Claims in conjunction with the appended drawing.

THE DRAWING

FIG. 1 is a side elevational view of the present racquet ball helmet.

FIG. 2 is a plan view thereof.

FIG. 3 is a bottom plan view thereof.

FIG. 4 is a fragmentary section taken in the direction of arrows 4—4 of FIG. 1, on an increased scale.

FIG. 5 is a frontal view showing wire and eye position.

It will be understood that the above drawing illustrates merely a preferred embodiment of the invention, and that other embodiments are contemplated, within the scope of the claims hereafter set forth.

DETAILED DESCRIPTION OF THE INVENTION

Referring to the drawing, the present racquet ball helmet is generally indicated at 11, FIG. 1, and is, of course, adapted for other sports of a similar nature involving a ball and a racquet or the like.

The helmet is preferably constructed of a plastic material, such as polystyrene, for example and includes a dome-shaped shell 13 adapted to protectively enclose the user's head, and has upon opposite sides thereof a pair of depending earpieces or projections 15.

Bill 17, normally arcuate, in the form of a viser, projects from a forward end of the shell. For maximum vision to the user, the bill lies in a plane substantially at right angles to a vertical frontal plane F passing through the helmet shell as shown in FIG. 1.

For increased comfort to the user and to provide for ventilation and cooling, there are provided within the earpieces a series of apertures or vents 19. Additional arcuate and elongated vents 21 are formed through the shell over portions thereof for increased ventilation.

A series of spaced apertures 23 are formed through lower portions of each earpiece at approximately one-quarter inch to one-half inch spacing and a series of additional spaced apertures 25 are formed through forward portions of bill 17.

A metallic wire 27 extends between side portions of each earpiece and a forward portion of the bill and is held taught and secured respectively to the corresponding side of the bill and the earpiece and inclined at such angle as to be spaced outwardly from and laterally of the pupil of the user's eye, as shown at E, FIG. 1.

In the illustrative embodiment, the wire 27 is of metal and is of a diameter of 3/32nds of an inch for maximum protection of the user's eyes.

The wire 27 is arranged taught, as shown, and extends between inside portions of the bill and corresponding earpiece. The respective threaded ends 29 project selectively through one of the earpiece apertures 23 and are sutiably secured thereto as by a fastener 33. The opposite end of each wire projects from the underside of bill 17 through a pre-selected aperture 25 and is suitably secured to the bill by such additional fastener 33 as will secure the wire in a taught position, as shown in FIGS. 1, 2, 3 and 4.

The respective ends of the wire in the illustrative embodiment are anchored tightly to the corresponding portions of the earpiece and bill by the use of washer 31, a nut 33 and a lock nut 35. This is for illustration, since other means of taughtly securing the wire ends may be employed. For example, the wire ends may be riveted or otherwise secured to corresponding portions of the respective earpiece and bill.

Depending upon the user's face and eye configuration and location, the use of the plurality of apertures 23 and 25 in the respective earpiece and bill permits the wire 27 to be secured at the desired angle so as to be spaced outwardly of and in generally lateral alignment with the pupil of the user's eye.

In the illustrative embodiment, the wire 27 extends at an angle of approximately 45 degrees to the horizontal, though this angle, of course, could be varied to the acute angular inclination needed for a particular user.

Upon the interior of the shell is a suitable lining or padding 37 of a resilient material such as a plastic foam of polyurethane or polystyrene or of a foam rubber composition. The padding is suitably secured to the interior of the shell by an adhesive plastic or rubber cement such as designated at 39, FIG. 3. The padding is slotted to correspond to vent openings 19 and 21.

As shown in FIG. 1, there is a dotted line configuration of a ball B to illustrate how the wire 27 protects the user's eye, when looking toward the rear.

FIG. 4 is a fragmentary section to illustrate the preferred form of anchoring the wire 27 and its respective opposite ends to the earpiece and bill.

The unique features of the present racquet ball helmet are as follows:

1. The angled taught wire from the bill of the helmet to the earpiece. There are a series of eight holes approximately ¼ inch apart in the helmet bill and a series of four spaced holes in each of the ear projections. These holes allow the wearer to adjust the wire so that the wire lies just lateral to and spaced outwardly from the pupil of each eye in a frontal projection. A wire so placed will not obscure frontal vision which is so important in racquet ball. The wires are so placed as also to protect the eye from a racquet ball in a frontal projectory. The wire and helmet properly adjusted will protect the eye from a racquet ball since the ball will strike the bridge of the nose or the wire and, thus, is prevented form striking the eye. 2. There is also protection for the player's eye when he turns to watch his opponent play his shot. He will be able to look between the wire and the bill of the cap and, thus, the eye is protected should the opponent's shot be directed at the user's eye.

3. Most of the head and face will be protected from blows, either by the racquet or the racquet ball with the additional protection that, should the player accidentally fall or trip, striking his head against the wall of the court.

4. The projecting bill of the cap is at least two inches long and, thus, protects the nose and upper face from being hit from the racquet.

5. The bill of the helmet projects at right angles to the frontal plane of the crown of the helmet so that there is less interference with upward gaze.

6. The helmet is vented at multiple locations for heat and sweat dissipation.

7. The interior of the helmet is padded with a foam rubber or a foam plastic material.

8. The wire attachment between the bill and the earpiece in the illustrative embodiment employs a threaded lock nut and fastener so that the player may adjust the angle wires so as to lie just laterally outward of the eye pupils. The wires may be attached by rivets following proper eye and pupil adjustment.

Having described my invention, reference should now be had to the following claims.

I claim:

1. A helmet for racquet ball and other sports comprising a dome-shaped head protective shell;

a bill projecting forwardly from one end of said shell;

a pair of earpieces depending from side portions of said shell;

and a pair of spaced taught wires, each wire at one end secured to an earpiece and extending forwardly with its other end separately secured respectively to forward portions of said bill, to protect the user's eyes against ball, racquet and wall impacts, without interferring with or obstructing frontal or lateral vision.

2. In the helmet of claim 1, a resilient padding lining secured to said shell and earpieces.

3. In the helmet of claim 2, said lining being a plastic foam material.

4. In the helmet of claim 1, the securing of said wires to said earpieces and bill including transverse apertures in said earpiece and bill;

the ends of said wires extending through said apertures;

and fasteners tightly anchoring said wire ends to said earpiece and bill respectively.

5. In the helmet of claim 4, there being a plurality of spaced apertures in said earpiece and bill;

the ends of said wire being selectively projected through the earpiece and bill apertures for a predetermined inclination so as to laterally overly the user's eye pupil.

6. In the helmet of claim 5, the ends of said wires being threaded;

and fasteners upon the exterior of said earpiece and bill respectively secured over the ends of said wires.

7. In the helmet of claim 1, a series of ventilating cutouts in said shell and earpieces.

8. In the helmet of claim 1, said shell and earpieces being of a plastic material.

9. A helmet for racquet ball and other sports comprising a dome-shaped head protective shell;

a bill projecting forwardly from one end of said shell;

a pair of earpieces depending from side portions of said shell;

and a taut wire secured to each earpiece and extending to and secured to forward portion of said bill, to protect the user's eyes against ball, racquet and wall impacts;

the securing of said wires to said earpiece and bill including a plurality of spaced transverse apertures in said earpieces and bill;

the ends of said wires being selectively projected through the earpiece and bill apertures for a predetermined inclination so as to laterally overlie the user's eye pupils;

the ends of said wires being threaded;

fasteners upon the exterior of said earpiece and bill secured over the ends of said wires;

there being a series of ventilating cutouts in said shell and earpieces;

said shell and earpieces being of plastic material.

* * * * *